US007055580B2

(12) United States Patent
Schildmann et al.

(10) Patent No.: US 7,055,580 B2
(45) Date of Patent: Jun. 6, 2006

(54) SYSTEM FOR CLEANING TUBES OF HEAT EXCHANGERS AND CLEANING BODIES FOR USE IN THE SYSTEM

(75) Inventors: Hans-Werner Schildmann, Heiligenhaus (DE); Dietmar Altegoer, Witten (DE); Rainer Kretzschmar, Witten (DE)

(73) Assignee: Taprogge GmbH, Wetter (DE)

( * ) Notice: Subject to any disclaimer, the term of this patent is extended or adjusted under 35 U.S.C. 154(b) by 0 days.

(21) Appl. No.: 10/719,591

(22) Filed: Nov. 21, 2003

(65) Prior Publication Data

US 2004/0099406 A1 May 27, 2004

Related U.S. Application Data

(63) Continuation-in-part of application No. 10/288,632, filed on Nov. 5, 2002.

(51) Int. Cl.
*F28G 1/12* (2006.01)

(52) U.S. Cl. ..... 165/95; 15/3.5; 15/3.51; 15/104.061

(58) Field of Classification Search ..... 165/5, 165/95, 119; 15/3.5, 3.52, 104.03, 104.05, 15/104.061, 3.51
See application file for complete search history.

(56) References Cited

U.S. PATENT DOCUMENTS

| | | | | | |
|---|---|---|---|---|---|
| 3,118,495 | A | * | 1/1964 | Hagby | 165/95 |
| 3,319,710 | A | * | 5/1967 | Heeren et al. | 165/95 |
| 4,556,102 | A | * | 12/1985 | Bochinski et al. | 165/95 |
| 4,569,097 | A | * | 2/1986 | Echols | 15/104.061 |
| 4,592,417 | A | * | 6/1986 | Baron | 165/95 |
| 4,891,115 | A | * | 1/1990 | Shishkin et al. | 204/212 |
| 5,311,929 | A | * | 5/1994 | Verret | 165/95 |
| 5,473,787 | A | * | 12/1995 | Echols | 15/104.061 |
| 5,617,604 | A | * | 4/1997 | Erich | 15/104.063 |
| 5,795,402 | A | * | 8/1998 | Hargett et al. | 134/8 |
| 5,983,994 | A | * | 11/1999 | Tsou | 165/94 |
| 6,014,789 | A | * | 1/2000 | Knapp | 15/104.063 |
| 6,308,363 | B1 | * | 10/2001 | Lino et al. | 15/104.061 |

FOREIGN PATENT DOCUMENTS

| | | | | |
|---|---|---|---|---|
| JP | 59-150296 | * | 8/1984 | 165/95 |
| JP | 61-280397 | * | 12/1986 | 165/95 |
| JP | 6-101991 | * | 4/1994 | 165/95 |

* cited by examiner

*Primary Examiner*—Terrell McKinnon

(57) ABSTRACT

In a system for cleaning tubes of tube-bundle type heat exchangers including a plurality of tubes (5) arranged in parallel between two chambers (10*a*, 10*b*) and flown through by a fluid medium, in particular crude oil, at a temperature above 120° C., wherein, for cleaning the tubes (5), deposits on their inner walls, such as coking, dirt particles or the like, are detached by cleaning bodies passing through the tubes (5), and carried out of the tubes (5), for cleaning the inner wall of the plurality of tubes (5) of the heat exchanger during the operation of the heat exchanger (10), it is provided that the cleaning bodies (1*a*–1*h*) are formed in such a way that they are resistant to high temperatures (above 120° C.) and withstand aggressive fluid media such as crude oil and are freely transported in the flowing fluid medium, in particular with large flow-through diameters, such as in the chambers (10*a*, 10*b*) of the heat exchanger (10) and sink or rise in the stagnant fluid medium, and have an outer contact surface suitable for removing deposits from a tube inner wall, pass through the tubes (5) due to the pressure of the fluid medium, and have their contact surfaces forced against the tube inner wall by contact pressure.

29 Claims, 8 Drawing Sheets

SYSTEM FOR CLEANING TUBES OF HEAT EXCHANGERS AND CLEANING BODIES FOR USE IN THE SYSTEM

This is a continuation-in-part of application Ser. No. 10/288,632 filed Nov. 5, 2002.

The invention relates to a system for cleaning tubes of tube-bundle type heat exchangers having a plurality of tubes arranged between two chambers and flown through by a fluid medium, in particular crude oil, at a temperature above 120° C., wherein for cleaning the tubes, deposits on the inside walls of the tubes such as coking, dirt particles and the like are detached by cleaning bodies passing through the tubes, and carried out of the tubes.

In crude oil processing, tube-bundle type heat exchangers, particularly so-called crude oil heaters (COH) are used to heat the crude oil using process waste heat in pre-heating stages to an operating temperature that is as high as possible, before, in the final heater and using external energy, it is heated to the temperature necessary for the crude oil that is passed to distillation.

Heating the crude oil is carried out in stages over a plurality of parallel and series-connected COH heat exchangers. The tubes of the heat exchanger are heated from the outside using the processing medium. Due to the heat transfer at the heat exchanger tubes there are deposits and caking of particles from the crude oil flowing on the inside of the tube. These degrade the heat transfer leading to a reduced heating of the crude oil.

The formation of deposits and caking on the tube inner wall is chemically counteracted by adding additives in controlled amounts to the crude oil before introducing it into the heat exchanger. Due to this process the deposit usually stays soft and can be more easily removed by mechanical means when compared to fast adhering cakings. However, the use of additives does not prevent deposit formation, but only delays it. The heat transfer at the heat exchanger tubes deteriorates as the deposit grows and builds up during operation so that mechanical cleaning is indispensible.

With respect to mechanical cleaning methods one can distinguish between those methods which necessitate interruption of the operation and opening of the heat exchanger and those becoming effective during operation of the heat exchanger. The latter methods comprise, on the one hand, cleaning members firmly mounted in the heat exchanger, and, on the other hand, systems in which the heat exchanger tubes are passed through by cleaning elements, as will be explained below.

Manual cleaning of heat exchangers is widely used. An essential drawback of this method is that operation of the heat exchanger, usually meaning the whole plant in which the heat exchanger is included, has to be shut down. The heat exchangers are opened up—to do this, they have to be arranged at a suitably accessible location and designed such that they are suitable to be periodically opened—and cleaned by conventional means such as using a high pressure cleaning apparatus or using brushes/scrapers. Apart from the high cost involved, also due to the interruption of the operation of the heat exchanger and the plant associated with it—a further drawback of this method is that while the deposit at the tube wall is removed, its formation, build-up and resulting deterioration of heat transfer cannot be avoided from the outset. Thus, between cleaning intervals, the heat transfer deteriorates considerably in the course of operation.

The mechanical cleaning methods effective in the running operation of the heat exchanger have to satisfy special requirements due to the very high operating temperatures, which are above 120° C. and can easily reach ranges of about 400° C., as well as due to the chemical stresses brought about by their use in an aggressive medium such as crude oil.

The use of cleaning elements mounted at fixed locations in the heat exchanger is based on the mounting principle for cleaning elements such as screw-shaped spring elements or the like at a receiving device at the intake of the heat exchanger, loosely arranged in the tubes and extending through the tubes. The cleaning elements are made of temperature and medium resistant materials. The receiving device facilitates axial movement of the cleaning elements in the tube. The shape and arrangement of the cleaning elements causes turbulences in the fluid medium delaying deposit formation. In addition, dirt particles or the like adhering to the inner wall of the tube are removed through the movement of the cleaning element, so that deposit formation is essentially prevented.

Such cleaning methods using firmly mounted cleaning elements, however, have a drawback, in that the cleaning elements arranged in the tube itself, usually over its entiry length, cause permanently increased friction losses in the fluid flow and thus increased energy consumption for the medium to be heated. Furthermore, the cleaning elements present obstacles in the free tube cross section so that dirt particles adhere to the cleaning elements and can lead to the tubes being clogged.

Mechanical cleaning methods with moveable cleaning bodies in the tubes use roller-shaped cleaning brushes that travel between the inlet and the outlet of the tube they are associated with and may thus remove a deposit from the tube inner wall. To do this, a basket is arranged at the inlet and the outlet of each tube. The basket at the outlet receives the brush after it has passed through the tube together with the fluid medium. The brush is then returned to the basked at the inlet side so that it is available for another cleaning pass through the tube.

To return the brushes in the baskets at the inlet side, the heat exchanger must either be switched off, so that there will be an opportunity to return the brushes from the outlet side to the inlet side. Or the tubing system for the heat exchanger is arranged such that for returning the brushes the heat exchanger has the medium flow through in reverse by switching over flow control elements causing the brushes caught in the baskets at the previous outlet side of the tube bundle of the heat exchanger to now pass through the tubes in the reverse direction with the medium flow and to be caught in the baskets at the previous inlet side, which is now the outlet side. The reversal of the flow direction of the fluid medium in the heat exchanger is carried out periodically.

The installation of a system having a reversable fluid flow direction involves apparatus of considerable technical complexity so that the cost involved with this system is very high. In view of the plurality of tubes in tube-bundle type heat exchangers, the installation of baskets at each end of each single tube also leads to high manufacturing, assembly and maintenance costs. If the receiving means get detached and lost, the associated brush also gets lost, and the tube will no longer be cleaned, without this being detected from the outside. Lost receiving devices and brushes are dangerous obstacles since they can adversely affect the free passage of the medium. Damaged or worn-out cleaning bodies may only be exchanged by switching off the plant and opening the heat exchanger. There is no other means of detecting wear and tear of the cleaning bodies. This means that the cleaning brushes do not thoroughly clean the tubes and they cannot generally be used optimally since the cleaning brushes are exchanged either too soon or too late.

WO 99/23438 discloses a system for cleaning the tube of single-tube heat exchangers used in particular as an end heater in petrochemical plants. The tube of such a heat exchanger usually has a meandering path and may easily reach a length of 1000 m. A cleaning body, also called a "pig", is passed through the single tube using the pressure of the fluid medium wherein the contact surface engaging the inner wall of the tube due to contact pressure removes deposits from the inner wall of the tubes and carries them out of the tube together with the fluid medium. The cleaning body has a cylindrical hollow form and its diameter is adapted to the diameter of the single tube. The pressure required to force the contact surface of the tube body to the inner wall of the tube is caused either by the pressure of the fluid medium or by a radially biased support structure, e.g. formed as a helical spring. The cleaning body is unilaterally closed in order to be able to utilize the impact pressure for forward movement. The cleaning body is made of metal so that it is temperature resistant as well as resistant against aggressive fluid media such as crude oil. The length of the cleaning body is always considerably greater than the diameter of the single tube.

By means of technical applicances the cleaning body is maintained in constant circulation or caught, stored and reinserted in the single tube when needed. The cleaning body always only cleans one tube, i.e. the single tube of the heat exchanger, in more than one pass, if needed.

Applying this well known cleaning system to tube-bundle type heat exchangers is not possible. With the cylindrical form of the cleaning body, the cleaning body is always guided inside the tube by the inner wall of the tube enclosing it on all sides and always in one and the same direction. The cleaning body therefore cannot be freely transported in the flowing fluid medium in large flow-through diameters, such as in the chambers of a tube-bundle type heat exchanger. Due to its great weight or its high density, the cleaning body would sink and would therefore sink for example to the bottom of a chamber of a tube-bundle heat exchanger on the inlet side in front of the tube plate of the heat exchanger and would only reach the bottom edge of the tube plate. Distributing such cleaning bodies over the surface of the tube plate of the heat exchanger is therefore impossible, and the cleaning body is not capable of aligning itself for entry into a tube.

Departing from a system of the type mentioned above, the object of the invention is therefore to provide a system for cleaning tubes of tube-bundle type heat exchangers for fluid media, in particular crude oil, at a temperature above 120° C., in which cleaning the inner wall of the heat exchanger tubes is carried out during the operation of the heat exchangers in spite of the great number of tubes in tube-bundle type heat exchangers. The system is intended to fulfill the requirements of a fluid medium having high temperatures and generally deemed to be chemically aggressive.

To solve the above object the present invention provides that a cleaning system of the above type is characterized in that

- the cleaning bodies are formed such that they
- are resistant to temperatures (above 120° C.) and
- are able to withstand aggressive fluid media such as crude oil and
- are freely transported in flowing fluid media, in particular with large flow-through diameters such as in the chambers of the heat exchanger and sink or rise in stagnant fluid media, and
- have an outer contact surface suitable for removing deposits from a tube inner wall,
- pass through the tube due to the pressure of the fluid medium and
- their contact surface is pressed against the tube inner wall due to contact pressure.

The system according to the invention allows for cleaning the tubes of tube-bundle type heat exchangers during the running operation of the heat exchanger and the remaining components of the plant associated with the heat exchanger.

The cleaning bodies provided to do this are resistant to high temperatures and aggressive fluid media, such as crude oil, due to a suitable choice of materials and a suitable structure. Their structure and density are chosen such that they are freely transported in the flowing fluid medium into the chamber on the inlet side of the tube-bundle type heat exchanger and spread out on the tube plate of the chamber in order to then enter into one of the tubes to be cleaned. They pass through each tube to be cleaned due to the pressure of the fluid medium by entering from the inlet side of the tube-bundle type heat exchanger starting from the chamber provided at the inlet of the tubes and, after passing through the tubes, leaving them again at the outlet. The result is a thorough cleansing of the inner wall of the tube, as the contact surface of the cleaning body, when it passes through the tube, contacts the entire surface of the inner wall of the tube and is forced against the inner wall of the tube due to contact pressure.

The contact surface of the cleaning body is formed in such a way that it catches and detaches deposits, such as coking, dirt particles or the like, adhering to the inner wall of the tube so that these are carried along by the fluid medium and/or the cleaning body itself and may be carried out of the tube. In this way it is impossible for a deposit, i.e. a long term build-up of dirt particles, to form on the inner wall of the tube. Caking on the inside of the tube is also avoided.

The heat transfer at the tubes of the heat exchanger, and therefore its efficiency, remains uniform and is not degraded. By continuous cleaning during the operation of the heat exchanger, conditions remain constant during the entire operating time.

The necessity to shut down and open the heat exchanger for tube cleaning—as in the prior art—is eliminated. It is not necessary to add additives to the fluid medium. At the inlet and outled sides of the heat exchanger, there is no need for expensive apparatus to introduce the cleaning bodies in the tubes and to catch them at the end of the tube.

According to a preferred embodiment of the invention, the cleaning bodies are collected after passing through the tubes and inserted in the inlet openings of the tubes for a further cleaning pass through the tubes, as needed. According to the particular circumstances, there may be a need for an immediate return of the cleaning bodies to the inlet side of the heat exchanger, or at a later point in time. It is essential that the cleaning bodies are not directed towards individual receiving devices at the outlet side, but that the cleaning bodies are collected and are collectively returned to the inlet side, in any case using a common path and not requiring costly recycling actions or measures.

Preferably, the cleaning bodies are recycled continuously or discontinuously, namely they are collected in a catching device after having passed through the tubes and either returned directly to the inlet side of the tubes for another pass or first collected in a receiving means, wherein the tube cleaning is interrupted and only resumed after a predermined period of time has elapsed or depending on the amount of dirt present in the tubes or on other parameters. This system variant is essential since it allows for automatic continuous or discontinuous recycling of the cleaning bodies so that cleaning of the inner wall of the tubes can generally be carried out very easily and efficiently without the need for substantial structural requirements.

A preferred embodiment of the invention provides a catching device for the cleaning bodies downstream of the outlet sides of the heat exchanger, such as a fixed or moveable sieve or filter for catching the cleaning bodies from the fluid flow. Stationary catching devices, such as filters or fixed sieves usually span the whole of the cross section of the outlet conduits on the outlet side of the heat exchanger. Moveable sieves may be switched between a neutral position in which they let pass the entire fluid stream including all component materials, and a collecting position in which they span the entire cross section of the outlet conduit of the medium to catch the cleaning body.

Downstream of each of the catching devices there is a lock for inserting and removing the cleaning bodies. In discontinuous operation, the lock may also serve for intermediate storage of the cleaning bodies during an interruption of the tube cleaning. For almost all interruptions, it is important that the cleaning bodies have the characteristic of sinking or rising in a stagnant fluid medium. This enables easy separation of the cleaning bodies from the fluid medium in order to store them in locks or the like.

Overall, a system for cleaning tubes of heat exchangers for fluid media such as crude oil having a temperature above 120° C. and having considerable aggressive chemical properties is provided, which is essentially different from the known systems discussed above and which for the first time allows or enables a sustainable cleaning of the tubes also for these media, without the need for considerable structural requirements. In particular, the system according to the present invention helps to avoid a situation where the operation of the heat exchanger and the components dependent on the operation of the heat exchanger of an entire plant, has to be interrupted and the heat exchanger has to be opened for tube cleaning. This is the first time that due to the invention there is a system for such media in which the cleaning bodies can be tested for usability when they are returned from the outlet side, by having the cleaning bodies pass through a corresponding testing apparatus.

It is evident that such a system is essentially distinguished from single-tube heat exchangers, wherein only a single cleaning body passes through the entire length of the single meandering tube and is always guided inside the tube such as when it is inserted, recycled and caught, and is not freely transported in the flowing fluid medium. It does not need to sink and rise in the stagnant fluid medium because it is always inside a tube which encloses and guides it.

According to the invention, cleaning bodies are also provided for cleaning tubes systems of heat exchangers, in particular tube-bundle type heat exchangers having a plurality of tubes arranged in parallel between two chambers and flown through by a fluid medium, in particular crude oil, at a temperature above 120° C., wherein the cleaning bodies are formed such that for cleaning the tubes of the heat exchanger, deposits on the inner walls, such as coking, dirt particles or the like are removed, and carried out of the tubes, when the cleaning bodies pass through the tubes.

The cleaning bodies of the present invention, while primarily used in tube-bundle type heat exchangers, may of course also be used in single-tube heat exchangers. With respect to the converse case, however, as shown above, cleaning bodies designed for single-tube heat exchangers are not at all suitable for use in tube-bundle type heat exchangers.

A particularly preferred embodiment of the cleaning bodies of the present invention is characterized by the cleaning bodies being formed such that they

- are resistant to temperatures (above 120° C.) and
- are able to withstand aggressive fluid media such as crude oil and
- are freely transported in flowing fluid media, in particular with large flow-through diameters such as in the chambers of the tube-bundle type heat exchanger, and sink or rise in stagnant fluid media, and
- have an outer contact surface suitable for removing deposits from a tube inner wall,
- pass through the tube due to the pressure of the fluid medium and
- their contact surface is forced against the inner wall of the tubes due to contact pressure.

For the first time, using these cleaning bodies, the present invention provides a relatively simple cleaning means, whereby the structure and the tubing system of the tube-bundle type heat exchanger for the fluid medium, namely in particular for the crude oil flow, is essentially unchanged. Compared to the prior art, there are no structural requirements. The operation of the plant is continued without the necessity of interruptions for opening up the heat exchanger to clean the tubes. Consequently, the overall effect shows a high degree of technological and economic advantages over and above previous cleaning bodies known for tube cleaning with heat exchangers for hot (above 120° C.) and also aggressive fluid media. Cleaning bodies of this type according to the present invention can be used in the inventive cleaning systems explained above, and thus the advantages already set out for these systems also apply to the inventive cleaning bodies themselves.

According to the invention the cleaning body is preferably formed to be an essentially spherical, resilient rolling body having a cleaning surface, the entire surface of the cleaning body forming the contact surface for removing deposits from the inner wall of the tube. This form and embodiment of the cleaning body of the present invention has substantial advantages. To start with, due to its spherical or ball shape, the body need not be inserted in the tube inlet of the tube to be cleaned in a particular orientation, but the cleaning body, after insertion in the tube, automatically adapts to the free inner cross section of the tube in any orientation without particular measures being required. Since the entire surface of the cleaning body forms a contact surface suitable for removing deposits, wherein the contact surface engages the inner wall of the tube, a high cleaning potential is provided due to the spherical shape. Due to its resilience the cleaning body can adapt to any possible practical variation in the form of the free cross section of the tube to be cleaned, for example when there is caking as a consequence of an unexpected transitory amount of dirt present in the fluid medium. Cylindrical cleaning bodies as in the prior art, on the other hand, are not suitable for use in tube-bundle type heat exchangers.

Preferably the outer diameter of the cleaning body in its uncompressed state, that is, before insertion of the cleaning body in the tube, is larger than the inner diameter of the tube, and the outer diameter of the cleaning body adapts to the inner diameter of the tube when the cleaning body is inserted at the inlet opening of the tube and in the process is resiliently compressed. In this embodiment of the cleaning body, the contact pressure with which the contact surface of the cleaning body engages the inner wall of the tube is generated by the resilient structure of the cleaning body. To achieve this the cleaning body in its uncompressed state is formed with a greater outer diameter than that corresponding to the inner diameter of the tube.

Cleaning bodies according to the present invention may be used in a variety of differently operated cleaning systems. It is therefore possible to use cleaning bodies of the invention for systems in which cleaning bodies basically reciprocate in a tube to be cleaned through the reversal of the fluid flow direction. Due to the provision of a reversable tubing system for the fluid medium, a relatively high amount of structural requirement is needed, as has been explained above. Such a cleaning system, however, is very much simplyfied by the use of the cleaning bodies of the present invention since, as explained above, the use of the cleaning body according to the invention is not dependent on any orientation. This has the advantage that not every cleaning body has to have its own receiving basket on either end of the tube to be cleaned, by which the cleaning body at the inlet and outlet sides is always oriented to the tube for it to be inserted and to pass through the same. According to the invention, the cleaning bodies may be caught as a batch, i.e. as a plurality, after a cleaning pass through the tube at its outlet side and inserted again into the tubes in a suitable way, either by fluid flow reversal at the previous outlet side or by returning the cleaning bodies as a batch to the previous inlet side, which will then always be the inlet side.

The cleaning bodies according to the invention are used to particular advantage in systems in which they are continuously or discontinuously recycled. In order to avoid undue repetitions, reference is made to the inventive systems explained above.

According to a preferred embodiment, the cleaning body comprises a buoyancy element on its inside and a cleaning element on its outside. The buoyancy element defines or influences the position or the path of the cleaning body in the fluid medium flow, while the cleaning element provides the function of cleaning the tube. The buoyancy element is intended to achieve that the cleaning body is freely transported in the flowing fluid medium, so that the cleaning bodies are preferably distributed, especially at the inlet side of the heat exchanger, i.e. in front of the tube plate, and the tubes are cleaned with about equal frequency. Thus, when designing the buoyancy element, it has to be kept in mind that an overall density of the cleaning body is adapted to the density of the processing medium, so that the cleaning body is freely transported in the flowing fluid medium. When forming the cleaning element, it is to be kept in mind that the spherical or ball shaped contact surface is primarily suitable for cleansing off deposits or dirt particles or the like deposited on the inner wall of the tube and is designed to be suitably abrasive.

With respect to the function of the bouyancy element it is useful for the buoyancy element to be arranged at the center of the cleaning body and to be made of one or more pressure resistant hollow bodies, or hollow bodies made pressure resistant, such as of metal, or of bodies having a low density, such as of metal foam. The pressure resistance requirements are largely dependent on the relatively high system pressure, which is present for example in systems for heating crude oil.

The contact surface of the cleaning element must have primarily an abrasive effect, so that deposits can be removed from the inner wall of the tube. To achieve this the cleaning element may be made of metal lamellae, knitted metal, braided metal, metal foil or the like, i.e. materials that are heat resistant and resistant to aggressive media, and having edges suitable for removing residues from the inner wall of the tube. It is also useful for the cleaning element to be resilient so that a corresponding contact pressure is exerted between the contact surface and the inner wall of the tube when the cleaning body enters the tube. Due to the resilient properties of the cleaning element, the directly effective section of the spherical or ball-shaped contact surface may correspond to a narrow strip-like flattening which extends in a circular form around the cleaning body and engages the inner wall of the tube.

It is not expected that a resilient binder material such as metal foam will carry the cleaning element and alone impart the necessary resilient behavior of the cleaning body. More likely the necessary elasticity will be generated by a combination of the binding material and the cleaning element. However, the cleaning element can be partially or wholly embedded in the binding material.

In case the deposits removed by the cleaning body from the inner wall of the tube stick fast to the contact surface of the cleaning body and are not detached from the contact surface by the fluid medium itself, the cleaning bodies may be cleaned before they are reinserted at the inlet side of the heat exchanger, such as by high pressure jet cleaning of the contact surface of the cleaning body, and/or by mechanical means such as brushes or the like. It is always possible to check the cleaning bodies with respect to wear or damage or the like during the return of the cleaning bodies from the outlet side of the heat exchanger to the inlet side.

According to an alternative embodiment of the cleaning bodies of the present invention, it is provided that the cleaning bodies each comprise at least one downstream—as viewed in the fluid flow direction of the fluid medium in the tube—buoyancy element and a cleaning element rigidly attached, or attached moveable with respect to the buoyancy element, to its rear side. In this embodiment the functions "buoyancy" and "cleaning" are distributed to two separate body portions, even if the two body portions are joined to form a cleaning body. When designing the buoyancy element the weight of the cleaning element has also to be taken into consideration. The buoyancy element enters the tube to be cleaned first and takes along the cleaning element attached to its rear side.

Conveniently, the buoyancy element has a ball-shaped or spherical form and takes on the function of a float made of one or more cavities or of corresponding porous structure. The diameter of the buoyancy element is suitably smaller than the inner diameter of the tube such that the buoyancy element may easily enter the tube inlet and pass through the tube as freely as possible.

The cleaning element of the present cleaning body is preferably leaf or disk shaped as well as circular, made of spring metal, and carries a crown of resilient lamellae, the crown being the contact surface to the inner wall of the tube. Consequently the diameter of the crown of lamellae is greater in its free state than in the tube when the rim of lamellae is resiliently compressed to the tube inner diameter thus creating the necessary contact pressure. When the cleaning body is within the tube, the pressure of the fluid medium mainly acts on the cleaning element in order to push the cleaning body through the tube together with the fluid medium. Depending on the design of the cleaning element, which can, for example, also have an outer crown in the form of a wire brush to form the cleansing contact surface, the front buoyancy element may also serve as a thrust body, by making, for example, the circular gap between the outside of the buoyancy element and the inner wall of the tube relatively small.

As an alternative to a fixed connection between the cleaning element and the buoyancy body, according to an embodiment of the present invention, the connection between the buoyancy body and the cleaning element allows limited relative radial movement and preferably limited relative axial movement of the buoyancy body and the cleaning element. It has been shown that this linkage allowing radial and axial play between the cleaning element and the buoyancy body helps with the alignment and the entry of the cleaning bodies in the tubes of the tube-bundle type heat exchanger.

Preferably, the cleaning element has clover-leaf type lamellae separated from each other by a wide gap and having rounded corners. This form of the cleaning element separates the lamellae from one another so that the lamellae cannot get jammed or suchlike at the ends of the tubes.

In particular with extremely low entry flow velocities of the crude oil onto the tube plate of the tube-bundle type heat exchanger, it is advantageous for a buoyancy element to be arranged on either side of the cleaning element. In this embodiment there is always one of the two spherical or pear-shaped buoyancy bodies downstream, so that the cleaning body at the tube plate may easily enter one of the tubes and pass through it in an aligned position. With this tripartite cleaning body, the above mentioned linkage between the cleaning element and the two buoyancy bodies is also preferred.

An essential preferred embodiment of the cleaning body according to the present invention is provided by designing the combination of the buoyancy element and the cleaning element—irrespective of whether the cleaning bodies are comprised of one or more portions—in their overall density and form in such a way that the cleaning bodies are freely transported in the flowing fluid medium, in particular with large flow-through diameters, such as in the chambers of the tube-bundle type heat exchangers. This causes the cleaning bodies to be distributed in the turbulent flow in the chamber at the inlet in front of the tube plate of the tube-bundle type heat exchanger.

It is further preferred that the material of the cleaning element and the material of the binding matieral, if any, and the material of the buoyancy element is temperature resistant (120° C. or more), resistant to aggressive media such as crude oil and is preferably made of metal.

Example embodiments of the invention are more fully explained with reference to the drawings, in which:

FIG. 1 is a schematic view of an exemplary tube-bundle type heat exchanger plant with a system for cleaning tubes of heat exchangers in which the tubes are passed through by cleaning bodies and the cleaning bodies are recycled in the plant;

FIG. 1*a* is a diagrammatic view of a further exemplary tube-bundle type heat exchanger plant as in FIG. 1, however having an alternative design of a lock used for recycling the cleaning bodies;

Figure 1:
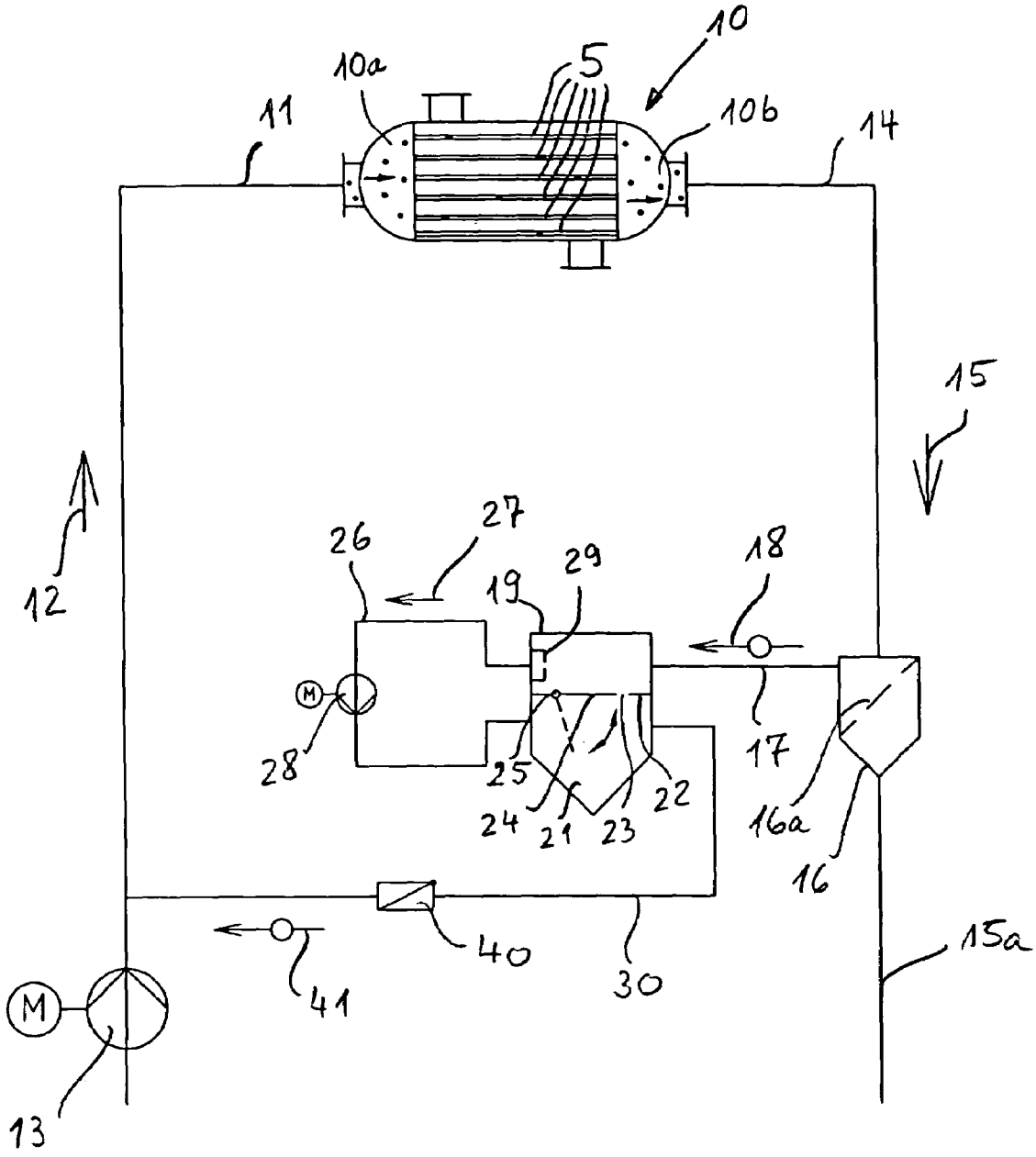

The plant shown strictly diagrammatically in FIG. 1 as an example embodiment serves to heat a crude oil flow in a tube-bundle type heat exchanger 10, to which the crude oil is fed through a supply conduit 11 in the direction of arrow 12 supported by a pump 13. Heat exchanger 10 comprises a bundle of about 100 to 500 tubes 5 arranged in the usual way between two chambers 10*a*, 10*b* in which the cruide oil is heated by process heat acting on the crude oil through the tube wall, while the crude oil is passing through tubes 5. Downstream of heat exchanger 10 the crude oil is extracted through conduit 14 in the direction of arrow 15 and fed to the next processing stage, which is usually the end heater. For example the temperature of the crude oil fed through the plant can be in the range of between 120° C. and 400° C.

For cleaning the tubes 5 of heat exchanger 10 during the running operation of heat exchanger 10 and the remaining components of the plant, cleaning bodies are provided which are schematically shown as small circles in chambers 10*a*, 10*b* in FIG. 1 and FIG. 1*a*, and more fully explained with reference to other drawing figures. The cleaning bodies are distributed in a turbulent flow of the fluid medium in chamber 10*a* at the tube plate of heat exchanger 10 in such a way that during a plurality of passes at least one cleaning body enters into the inlet of each tube 5. Each cleaning body freely passes through tube 5 to be cleaned due to the pressure of the crude oil flow by entering at the inlet of tube 5 and leaving tube 5 at its outlet in chamber 10*b*. This results in a thorough cleaning of the inner wall of the tube. Any deposits such as dirt particles, e.g. coking, adhering to the inner wall of the tube will be abraded by the cleaning body and carried out of tubes 5 together with the crude oil flow. In order to efficiently clean tubes 5, it is important that the cleaning bodies are formed such that they are freely transported in the flowing fluid medium, in particular with large flow-through diameters, such as in chambers 10*a*, 10*b* of tube-bundle type heat exchanger 10, and sink or rise in the stagnant fluid medium. In order to avoid undue repetition, reference is made to the description of the system according to the present invention as well as to the cleaning bodies according to the present invention in the introductory portion of the present specification.

The representation of FIG. 1 primarily shows a preferred embodiment of the system according to the invention, wherein the cleaning bodies are continuously or discontinuously recycled. This means that after passing through tubes 5, the cleaning bodies are first retrieved from the crude oil flow of conduit 14 by a catching device 16 and diverted through a conduit 17 in the direction of arrow 18, while the crude oil flow leaves the plant without cleaning bodies via an exit conduit 15*a*. In the catching device 16, a filter can be provided as a stationary catching device spanning the entire cross-section of catching device 16. However, also moveable or fixed sieves (schematically shown as a broken line 16*a* in FIG. 1) can be used as a catching device 16. The sieves are switcheable between a neutral position in which they let pass the whole of the crude oil flow, and a collecting position in which they span the whole of the cross section of catching device 16 and remove the cleaning bodies from the crude oil flow.

In the case of a continuous cleaning operation of tubes 5 of heat exchanger 10 the cleaning bodies are directly recycled from conduit 17 to supply conduit 11 (not shown).

In the case of discontinuous recycling, or introduction into supply conduit 11, of the cleaning bodies—either periodically after a predetermined period of time has elapsed or depending on the amount of dirt present in tubes 5 or on other parameters—the cleaning bodies are fed via conduit 17 to a collecting device, i.e. a lock 19, in which they are collected and, at a predetermined time, reintroduced into supply conduit 11 via conduit 30 and a check valve 40 in the direction of arrow 41. To do this lock 19 has been divided into an upper chamber 20 and a lower chamber 21 separated from each other by a bottom wall 22. In the bottom wall, there is an opening 23 closed by a flap 24 pivotable around axis 25, while the cleaning bodies are collected in the upper chamber 20. In a bypass 26, extending from the upper chamber 20 and coupled at its other end in a particular position to the lower chamber 21, a pump 28 is provided to feed the crude oil coming from conduit 17 through a wire basket 29 or the like, which does not allow cleaning bodies to pass, from the upper chamber 20 to the lower chamber 21 in such a way that the flow entering it, as indicated by the double arrow, holds flap 24 in the closed position of opening 23 as long as the cleaning bodies are collected in the upper chamber 20. When the pump 28 is switched off, the flap 24 sinks to the open position indicated in the drawing by a broken line, so that the cleaning bodies are allowed to pass from the upper chamber 20 to the lower chamber 21.

At the beginning of a new cleaning cycle flap 24 is in the open position. The cleaning bodies are located in the lower chamber 21. As soon as the drive of pump 28 is energized, flap 24 is pivoted to its upper closed position due to the crude oil flow from the bypass conduit 26 directed against the flap 24. The cleaning bodies are carried by the crude oil flow from the bypass conduit 26 into conduit 30, in which check valve 40 is opened at the start of the cleaning cycle by the pressure of the fluid medium, and carried from there to the inlet conduit 11. Cleaning bodies collected by catching device 16 during the cleaning cycle are returned via conduit 17 to the upper chamber 20, while opening 23 is held closed by flap 24. At the end of the cleaning cycle, the drive of pump 28 is deenergized. The crude oil flow from bypass conduit 26 ceases so that flap 24 is pivoted back from its closed position into its opened position by the action of gravity. Check valve 40 prevents a return flow of the medium. The cleaning bodies descend from the upper chamber 20 through opening 23 to the lower chamber 21. They stay there waiting for the next cleaning cycle.

The mode of operation described with reference to FIG. 1 is used with sinking cleaning bodies, i.e. cleaning bodies having a greater density than the operating medium (e.g. crude oil). For cleaning bodies with a lower density, i.e. cleaning bodies which rise in the operating medium, also perhaps crude oil, an alternative design and operating mode of the lock has to be provided. An example embodiment of such a lock can be seen in FIG. 1*a* in a schematic view. The following description is essentially limited to the structure and operation of the lock.

This lock 19, similar to lock 19 in FIG. 1, is divided into upper and lower chambers 20, 21 and separated by a bottom wall 22. An opening 23 is provided in the bottom wall 22, to be closed by a flap 24 pivotable around an axis 25, while the cleaning bodies are being collected in the lower chamber 21. In a bypass 26, extending from the lower chamber 21 and being coupled at its other end in a particular position to the upper chamber 20, a pump 28 is provided, as in the embodiment mentioned above, to feed crude oil coming from conduit 17 through wire basket 29 or the like which does not pass any cleaning bodies, from the lower chamber 21 to the upper chamber 20 in such a way that the flow entering it, as indicated by the double arrow, holds flap 24 in the closed position of opening 23 against the spring force of a spring 24*a*, as long as the cleaning bodies are being collected in the lower chamber 21. As soon as pump 28 is deenergized, the flap 24 is opened by the force of the spring to the open position indicated with broken lines in the drawing, so that the cleaning bodies rise from the lower chamber 21 to the upper chamber 20.

At the start of each new cleaning cycle, flap 24 is in the open position. The cleaning bodies are in the upper chamber 20. As soon as the operation of the pump 28 is started, flap 24 is pivoted downwards to the closed position against the spring force due to the effect of the crude oil flow coming from bypass conduit 26 and directed against flap 24. The cleaning bodies are carried by the crude oil flow from bypass conduit 26 into conduit 30, in which check valve 40 is opened at the start of the cleaning cycle by the pressure of the fluid medium, and from there back to the inlet conduit 11. Cleaning bodies collected by catching device 16 during such a cleaning cycle are returned through conduit 17 to the lower chamber 21 and collected there because opening 23 is held closed by flap 24. At the end of the cleaning cycle, the drive of pump 28 is deenergized. The crude oil flow from the bypass conduit 26 ceases, so that flap 24 is pivoted by the spring force from the closed position back to the open position. The cleaning bodies rise from the lower chamber 21 through opening 23 to the upper chamber 20. They stay there waiting for the next cleaning cycle.

Eight different example embodiments of cleaning bodies will be described in the following with reference to FIGS. 2 to 11, wherein in order to avoid undue repetition, at the same time, reference is made to the introductory portion of the present specification.

Figure 2:
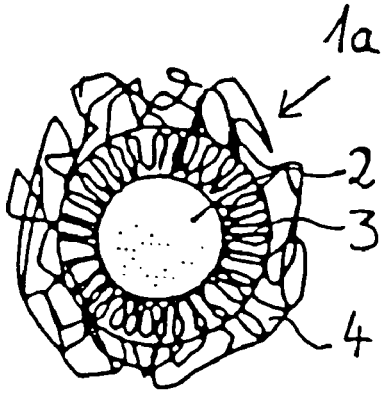
FIG. 2 is a cross-sectional diagrammatic view of a first exemplary embodiment of a cleaning body.

In the first example embodiment of FIG. 2, a cleaning body 1*a* is comprised of a central, spherical hollow body as a buoyancy element 2 having an outer abrasive cleaning element 4 made of knitted metal firmly secured on buoyancy element 2 by means of an intermediate metallic resilient medium 3. The connection of the component parts is done by conventional methods of connecting, such as welding, glueing, soldering or the like. Buoyancy element 2 in this case is relatively small compared to cleaning element 4, whose knitted metal as well as the structure of the resilient medium 3 is relatively loose so that buoyancy element 2 with reference to the desired overall density of cleaning body 1*a* has to counterbalance only a relatively light weight. In principle, the density of cleaning body 1*a* is to be adjusted to the density of the medium, unless there are circumstances which allow or even require a substantial difference. All parts of cleaning body 1*a* are made of metal—excepting the adhesive agent, which can also be a high-temperature resistant plastics material. The knitted metal of cleaning element 4 is made of poly-edged, in particular rectangular, stainless wire or strip steel material, whereby cleaning element 4 in combination with resilient medium 3 provides cleaning body 1*a* with the necessary resilient property. In order to achieve this, resilient medium 3 is of resilient wound metal lamellae or a corresponding resilient metal mesh, each being attached, in the form of a hollow sphere, on buoyancy element 2—a pressure resistant hollow metal sphere. Regardless of which metal or other material is selected for the component parts of cleaning body 1*a*, the component parts are designed to withstand processing temperatures of up to 400° C. and to withstand an aggressive process medium, such as crude oil. These prerequisites also apply to the further example embodiments described below. For resilient medium 3, a tube-like mat of knitted spring steel wire may also be used, the tube soldered or welded at both ends for closing and fixing purposes. The elasticity of this layer is essential, so that the cleaning body 1*a* may easily adapt to the inner diameter of the tube to be cleaned, while still exerting a pressure on the inner wall of the tube, when passing through the tube, sufficient for removing dirt from the inner wall of the tube. The knitted metal or rib mesh of cleaning element 4 is secured on resilient medium 3 by soldering or any other conventional securing method, as mentioned above. The blank thus created is finally pressed into a spherical form. The spherical hollow body of buoyancy element 2 is formed, for example, of two deep-drawn metal cup halves.

Figure 3:
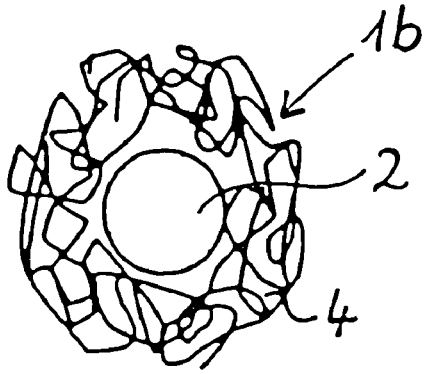
FIG. 3 is a cross-secitonal diagrammatic view of a second exemplary embodiment of a cleaning body.

With respect to the second example embodiment according to FIG. 3, cleaning body 1*b* is made of a pressure resistant hollow metal sphere as buoyancy element 2 with an essentially spherically shaped cleaning element 4 of metal mesh or rib mesh of spring steel secured to it. The securing on buoyancy element 2 and stabilisation of the resilient material of cleaning element 4 is done e.g. by soldering. Since cleaning element 4 is in this case very resilient, no additional resilient medium is needed as in the first example embodiment, and also in this case, the buoyancy element 2 is relatively small when compared to cleaning element 4.

Figure 4:
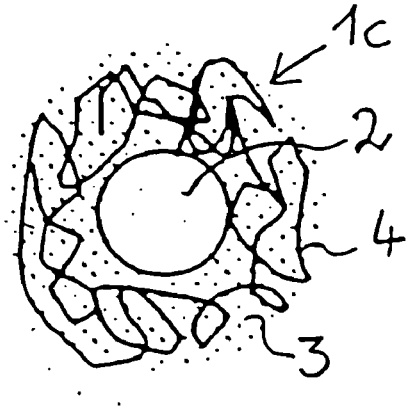
FIG. 4 is a cross-secitonal diagrammatic view of a third exemplary embodiment of a cleaning body.

With reference to the third example embodiment according to FIG. 4, cleaning element 4 is secured on the spherical buoyancy element 2, wherein cleaning element 4 may consist of knitted metal or metal mesh as in the previous example embodiments, may be both secured directly on the buoyancy element 2 e.g. by soldering, and additionally may be wholly or partially embedded in the resilient medium 3, which may comprise a temperature resistant elastomeric material or a resilient metal foam. In this case cleaning medium 4 and the elastomeric material are both brought into the desired spherical shape, if desired in a single processing step, and the elastomeric material is formed into the desired spherical shape in an injection mold, and the elastomeric material is injected into the rib mesh or knitted metal structure. This manufacturing method is particularly easy to carry out. As in all previous example embodiments, welding, glueing, soldering or the like is used here as a securing method.

Figure 5:
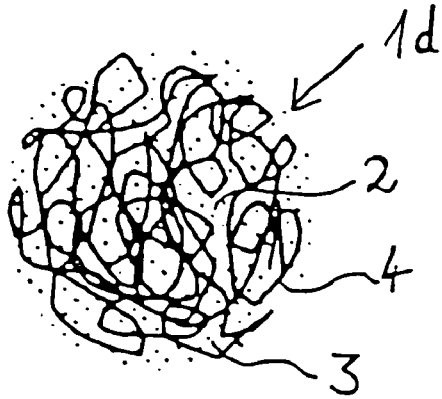
FIG. 5 is a diagrammatic view of a fourth exemplary embodiment of a cleaning body.

With reference to the fourth example embodiment according to FIG. 5, the cleaning body 1*d* does not include a separate buoyancy body 2, but a cleaning element 4 consisting of metal lamellae, knitted metal, metal mesh or rib mesh is directly embedded in a resilient medium 3 consisting of a resilient metal foam or a temperature resistant elastomeric material and simultaneously acting as a buoyancy element 2.

Figure 6:
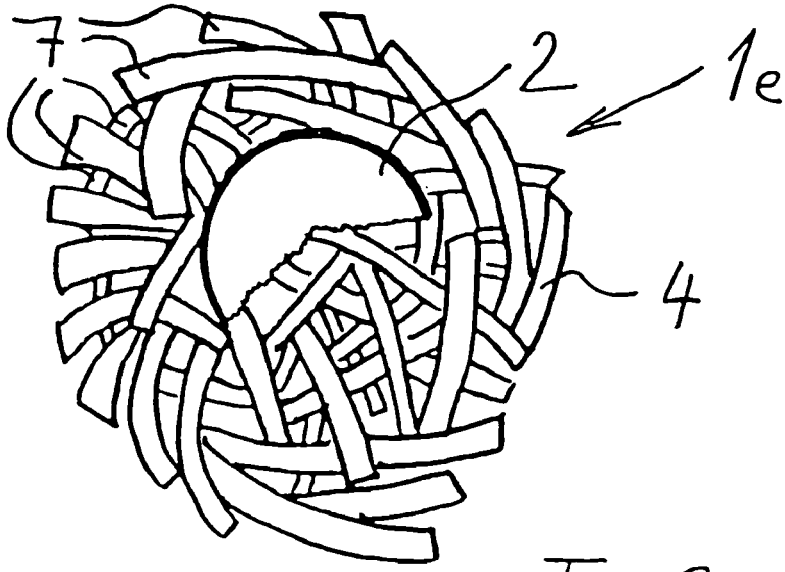
FIG. 6 is a partial sectional view of a fifth exemplary embodiment of a cleaning body.
Figure 7:
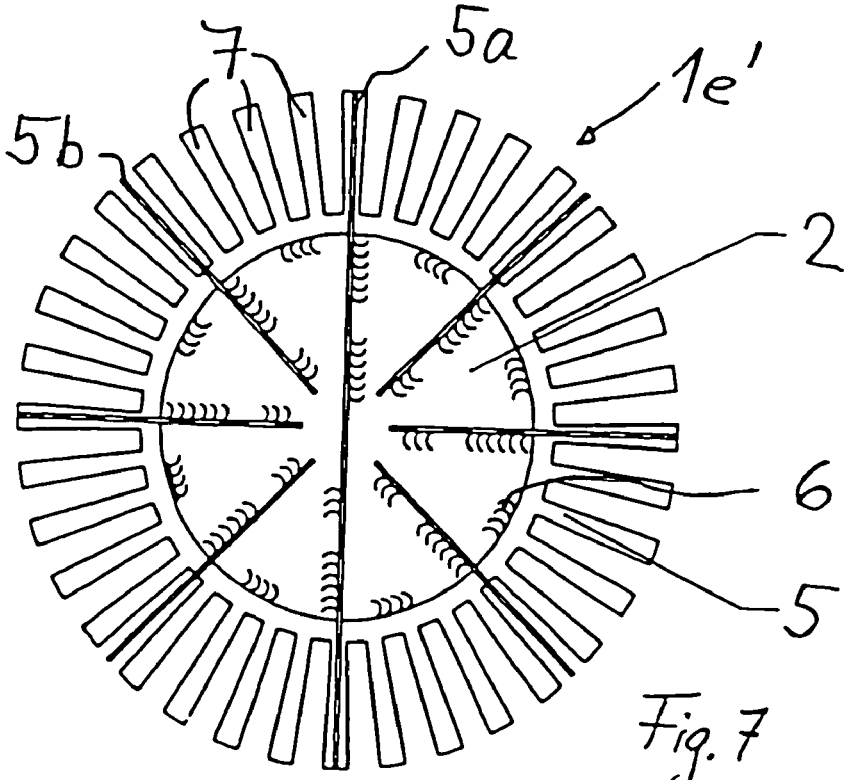
FIG. 7 is a view of a blank of the exemplary embodiment of a cleaning body according to FIG. 6.

With reference to the fifth example embodiment of a cleaning body 1*e* according to FIG. 6, buoyancy element 2 is, again, substantially smaller than cleaning element 4, and the present cleaning body 1*e* is manufactured from blank 1*e*' shown in FIG. 7. First, a ronde 5 of spring steel, slotted on the outside as shown in FIG. 7, is soldered onto the metal sphere of buoyancy element 2, such as indicated at 6. Subsequently, two ronde halves 5*a* are soldered onto buoyancy element 2 at an angle of 90° with respect to the ronde 5, whereafter semi-circular or quadrant-shaped ronde segments 5*b* are arranged and soldered in the symmetrical manner evident from FIG. 7 in the remaining intermediate spaces on buoyancy element 2. Then the external radially extending webs 7 of the ronde 5 as well as the ronde halves 5*a* and the ronde segments 5*b* are deformed in such a way that the spherical form shown in FIG. 6 of cleaning body 1*e* is created, having sharp-edged webs or lamellae 7 on the outside and an overall elasticity so that they are able to adapt to the inner diameter of the tube 5 to be cleaned and still exert sufficient pressure for removing dirt from the inner wall of tube 5.

In all of the previously described example embodiments of the cleaning bodies, the weight is selected such that the density of the cleaning body is adapted to the density of the medium, so that the cleaning bodies may be freely transported in the fluid medium flow and primarily distributed at the tube plate of heat exchanger 10 when the cleaning bodies are to be fed into tubes 5 to be cleaned.

Possible exceptions have been pointed out in the description of the first example embodiment.

For cleaning the tubes, e.g. of the tube-bundle type heat exchanger 10 of the plant shown in FIG. 1, cleaning bodies 1*a*–1*e* are fed via the supply conduit 11 for the crude oil flow on the inlet side of heat exchanger 10 thereby passing into chamber 10*a* and thus to the area in front of the tube plate of heat exchanger 10. When the crude oil flow is distributed to the individual tubes 5 of heat exchanger 10, cleaning bodies 1*a*–1*e* are easily carried along so that they enter the inlet of one of tubes 5 to be cleaned of heat exchanger 10. Cleaning bodies 1*a*–1*e* are resiliently compressed in the process until they have reached the inner diameter of the tube. Thus a contact pressure is generated which is necessary for pressing the contact surface, i.e. the outer surface of cleaning elements 4 of cleaning bodies 1*a*–1*e*, to the inner walls of tubes 5 to be cleaned. Due to the action of the contact pressure, deposits of dirt particles or the like are removed from the tube inner wall when cleaning bodies 1*a*–1*e* pass through tubes 5, the fluid pressure of the fluid medium acting as a thrust force on cleaning bodies 1*a*–1*e*.

Figure 8:
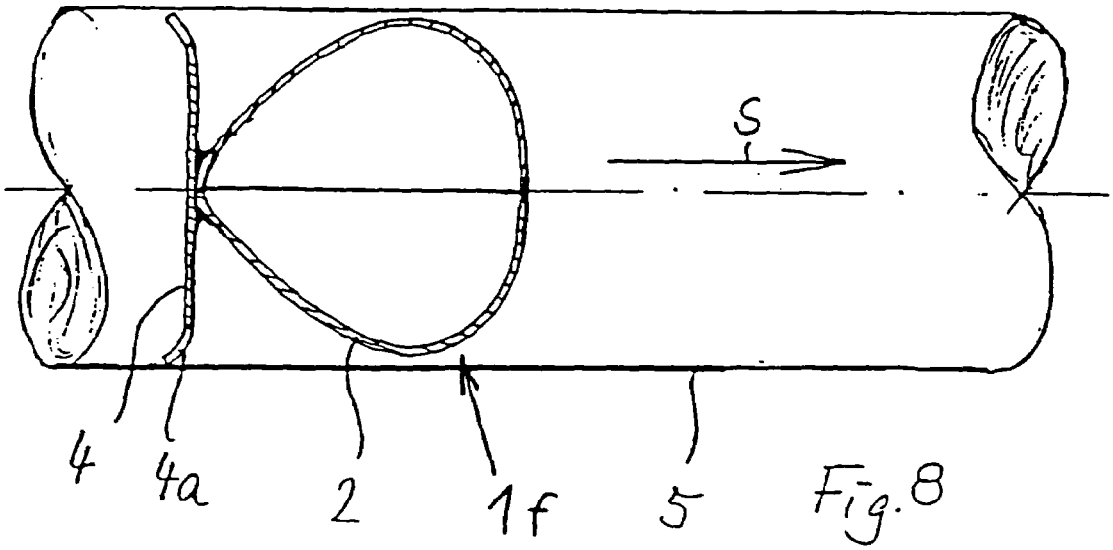
FIG. 8 is a sectional view of a sixth exemplary embodiment of a cleaning body, the cleaning body having a two-part form.

Unlike the previously described example embodiments, in the sixth example embodiment, as shown in FIG. 8, cleaning body 1*f* comprises two parts. As a cleaning element 4, a circular as well as leaf shaped disk of spring steel having a thickness of about 0.05 to 0.5 mm is centrally secured, as shown, for example by welding or soldering, to a front (as seen in the fluid flow direction S) hollow metal body, preferably spherical, for example, pear- or ball-shaped, as a buoyancy element 2. The required strength or stability determines the minimum thickness of said disk, wherein its diameter is greater than the inner diameter of tubes 5 to be cleaned. At the outer rim of cleaning element 4 there is a crown of resilient lamellae 4*a* which, at the insertion of cleaning element 4 into tube 5 to be cleaned, is resiliently flexed so that the outer diameter of cleaning element 4 adapts to the inner diameter of the tube, and lamellae 4*a* are forced against the inner wall of tube 5 with the required contact pressure. In this way, lamellae 4*a* of cleaning element 4 are able to remove deposits of dirt particles or the like from the inner wall of tube 5, when the cleaning body 1*f* passes through tube 5 by the action of the fluid medium. As in the previously described example embodiments, the density of the cleaning body is, again, adapted to the density of the fluid medium. With respect to the selection of the metal and the connection between the buoyancy element 2 and the cleaning element 4, the cleaning body 1*f* is designed to withstand operating temperatures of about 400° C. as well as to withstand the chemically aggressive properties of crude oil, forming the fluid flow medium.

For the purposes of practical implementation it has been found that cleaning body 1*f* in the two-part form, such as shown in FIG. 8, performs an automatic alignment in the area of the tube plate of the heat exchanger when the cleaning bodies 1*f* are fed into tubes 5 to be cleaned, at the latest before the inlet of tubes 5 to be cleaned, in such a way that buoyancy element 2 always enters the inlet of tube 5 first and cleaning element 4 follows buoyancy element 2, so that the position shown in FIG. 8 of cleaning body 1*f* in tube 5 is automatically achieved. It is also quite unproblematical to remove cleaning bodies 1*f* in catching device 16 from the crude oil flow of conduit 14, divert them to conduit 17 and either feed them directly into supply conduit 11 for continuous cleaning of the tubes of the tube-bundle type heat exchanger, such as heat exchanger 10 of the plant shown in FIG. 1, or transport them via conduit 17 in lock 19, provided as a collecting device, and return them from there to supply conduit 11 at the appropriate time. The disk of the cleaning element 4 can have a greater thickness near its center than near its periphery. This is because the resilience required for adaptation to the inner diameter of tube 5 must be exerted exclusively by the outer rim of cleaning element 4. Moreover, the hollow body or the sphere of buoyancy element 2 can be made substantially smaller than in the example shown in FIG. 8. It is also pointed out that with respect to cleaning body if, the blocking of tube 5 needed for creating the required pressure difference is solely effected by the disk of cleaning element 4. This feature is also important for automatically aligning cleaning body 1*f*.

Figure 9:
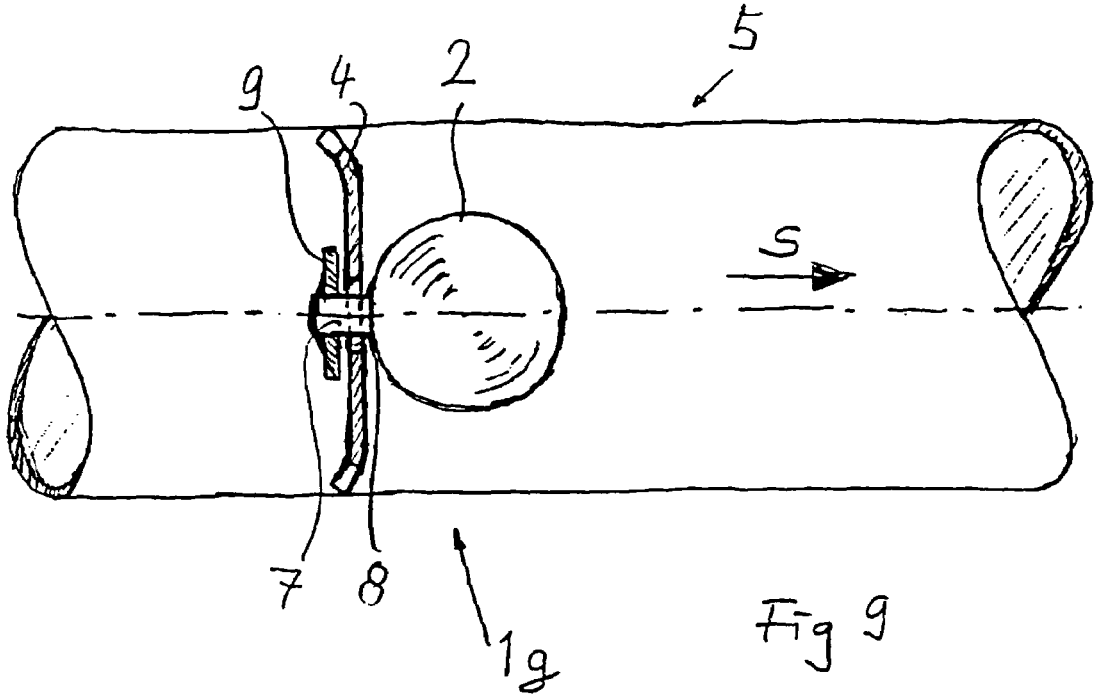
FIG. 9 is a sectional view of a seventh exemplary embodiment of a cleaning body in a two-part form in one of the tubes to be cleaned.

The seventh exemplary embodiment shown in FIG. 9 in the cleaning position in tube 5 is distinguished from cleaning body 1*f* of FIG. 8 in particular in that buoyancy body 2 is not rigidly but moveably connected to cleaning element 4. A stud 7 is attached on buoyancy body 2 extending through a central opening 8 in cleaning element 4 and having, as shown, on its free end a disc 9 as an axial limitation of the relative mobility of buoyancy element 2 with respect to cleaning element 4 in an axial direction. A relative mobility of buoyancy element 2 and cleaning element 4 in a radial direction is allowed by the diameter of opening 8 being larger than the diameter of stud 7. It has been shown that this linkage between buoyancy body 2 and cleaning element 4 facilitates entry of cleaning body 1*g* into tube 5 and cleaning body 1*g* assumes the position shown in the drawing when passing through tube 5.

Figure 10:
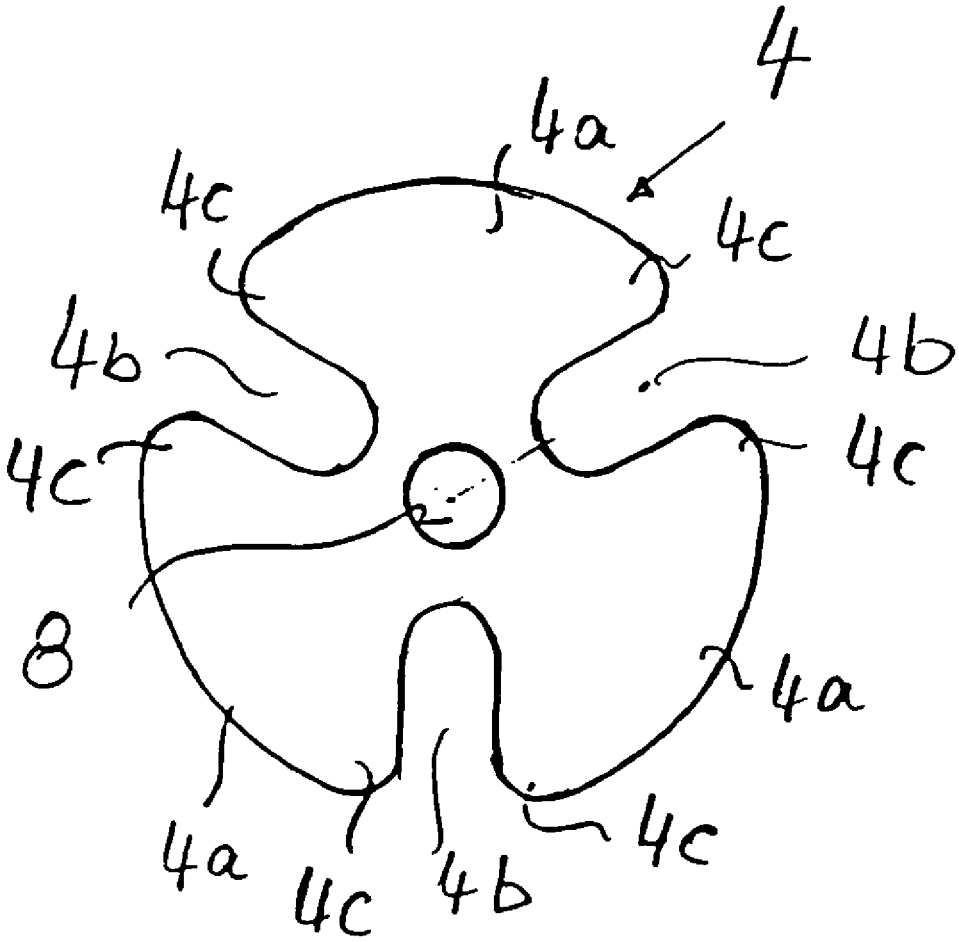
FIG. 10 is a front view of a cleaning element to be used with a cleaning body of the embodiment of FIG. 9 as well as in a corresponding adaptation also according to FIG. 8.

As cleaning element 4, a leaf-like disc of spring metal, as shown in FIG. 10, is preferred for the creation of cleaning body 1*f* and 1*g*, as well as 1*h*. Resilient lamellae 4*a* are separated from one another by a wide gap 4*b* and have rounded corners 4*c* in order to obviate any risk of adjacent lamellae 4*a* jamming, such as at a tube nozzle. Opening 8 for stud 7 of buoyancy body 2 is in the middle.

Figure 11:
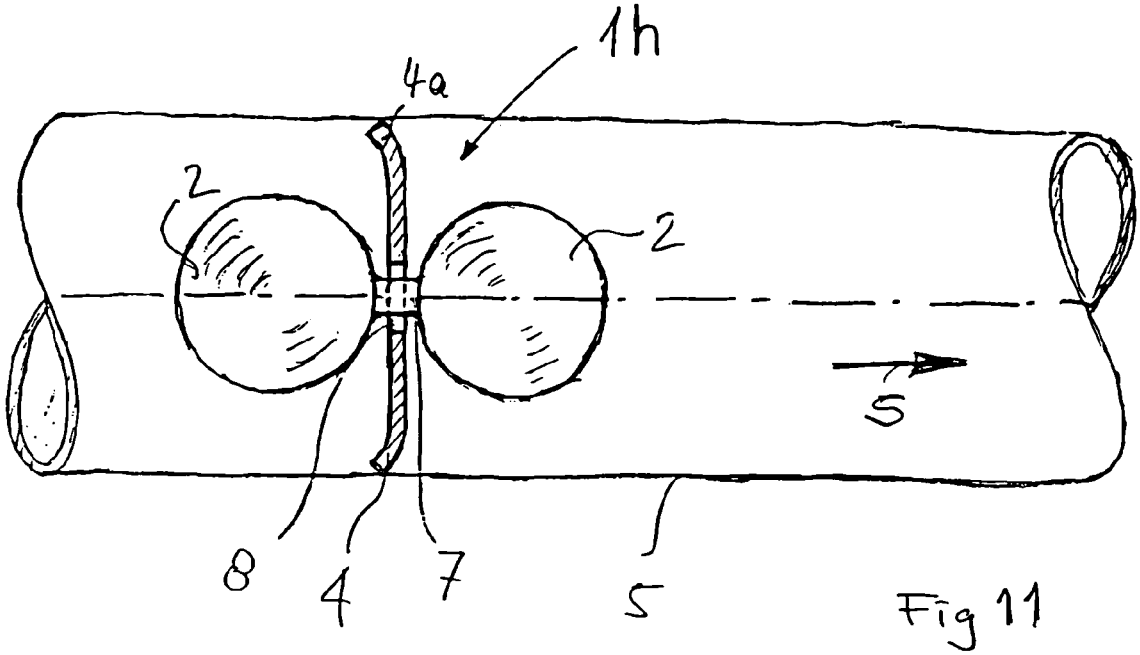
FIG. 11 is a sectional view of an eighth exemplary embodiment of a cleaning body in a tripartite form.

The eighth embodiment of a cleaning body 1*h*, as shown in FIG. 11, is different from the embodiment according to FIG. 9 in that there are two buoyancy bodies 2, so that one buoyancy body 2 is arranged on either side of cleaning element 4. Stud 7 links the two buoyancy bodies 2 and at the same time creates a connection to cleaning element 4, namely with a limited radial and axial relative mobility of buoyancy bodies 2 with respect to cleaning element 4*a*, as in the exemplary embodiment of FIG. 9. In each direction of movement, there is always one of the two spherical or pear-shaped buoyancy bodies 2 downstream, as seen in the flow direction S, so that tube 5 is always passed through in the position shown. Cleaning element 4 adapts to the inner diameter of tube 5 to be cleaned as with the other embodiments, so that deposits are removed.

Figure 1A:
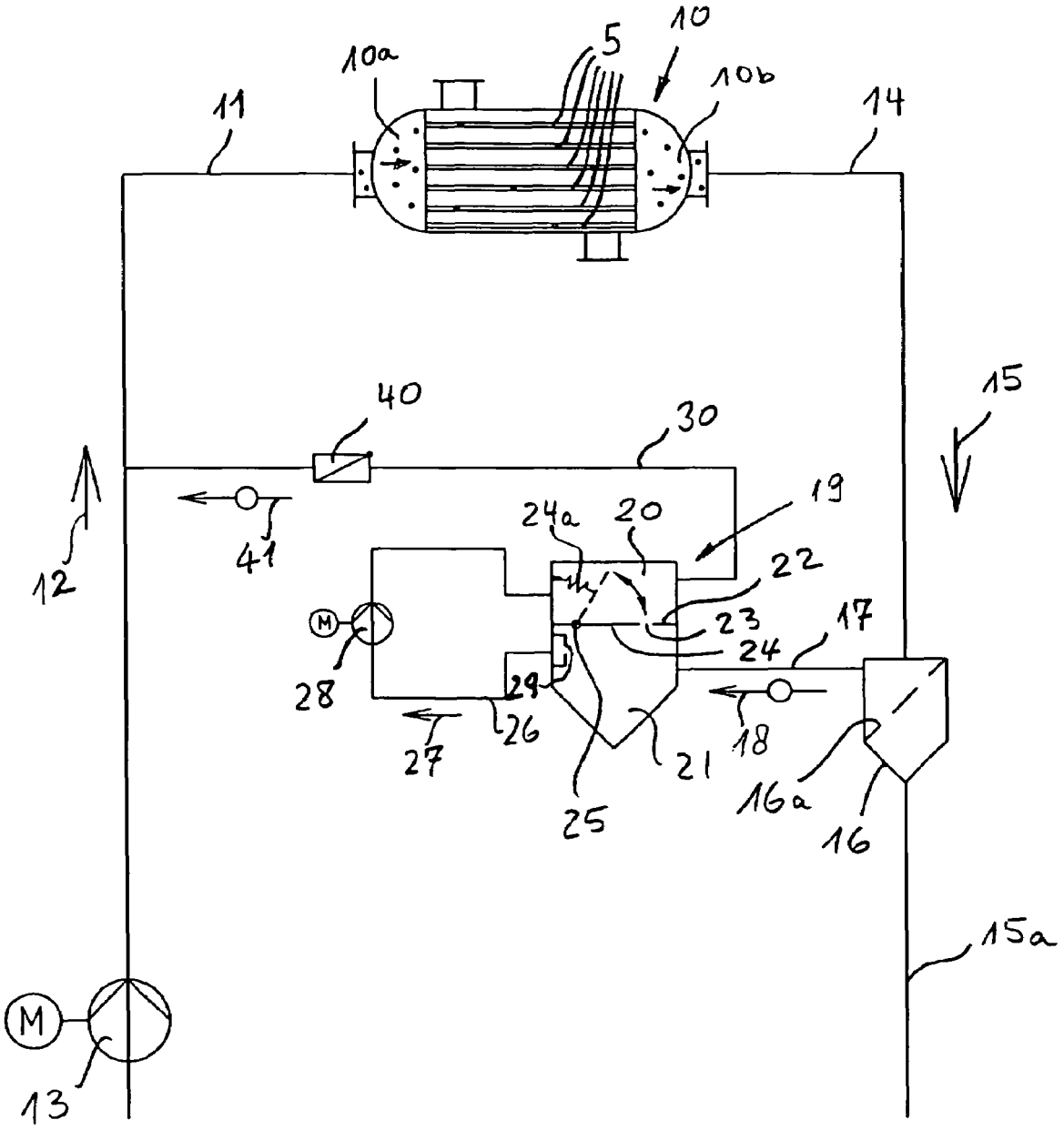

The representations of FIGS. 1 and 1*a* and the operating modes described are exclusively intended to be exemplary embodiments to which the invention is in no way limited.

In particular, it should be pointed out that the inventive cleaning bodies may not only be used in plants for processing crude oil but also in other plants being operated at high temperatures above 120° C. Thus the cleaning bodies are also useful for cleaning evaporator tubes in desalination plants and other high temperature applications. Using the cleaning bodies for special applications, such as with aggressive media in the chemical industry, is also possible.

Finally, it should be pointed out that cleaning bodies according to the present invention can also be used in tubing systems operated at temperatures below 120° C. The operating temperature above 120° C. is mentioned so frequently in the above description as well as in the appended claims because the cleaning bodies according to the present invention are intended to be suitable primarily for heat exchangers, in which crude oil circulates as a medium at a high temperature, without the use of the cleaning bodies of the present invention being limited to such application.

What is claimed is:

1. System for cleaning tubes of tube bundle type heat exchangers including a plurality of tubes arranged in parallel between two chambers and in which a fluid medium circulates at a temperature greater than 120° C., comprising cleaning bodies for cleaning said tubes of deposits at inner walls of said tubes, wherein said cleaning bodies have contact surfaces if or contacting inner walls of said tubes and removing said deposits, and wherein said cleaning bodies are made of a material which maintains said contact surfaces at temperatures greater than 120° C.

2. The system of claim 1, wherein said fluid medium is crude oil and wherein said material maintains said contact surfaces when in contact with crude oil.

3. The system of claim 1, wherein said cleaning bodies are made of a material selected relative to said fluid medium whereby said cleaning bodies are freely transported in said fluid medium when flowing, and sink or rise in said fluid medium when stagnant.

4. The system of claim 1, wherein said cleaning bodies have said contact surfaces of a size selected to be forced against the tube inner wall.

5. The system of claim 1, further comprising means for collecting said cleaning bodies after they are transported through said tubes, and for introducing said cleaning bodies into inlet openings of said tubes.

6. The system of claim 5, further Comprising a catching device for catching said cleaning bodies after passing through said tubes.

7. The system of claim 6, wherein said catching device comprises a filter or a moveable or fixed sieve in a recycling conduit for said cleaning bodies between an outlet and an inlet side of said heat exchanger.

8. The system of claim 7, further comprising a lock, positioned downstream of the catching device, for filling, retrieving and intermediate storage of said cleaning bodies during interruption of tube cleaning.

9. Cleaning bodies for systems that clean tubes of heat exchangers, in particular tube-bundle type heat exchangers including a plurality of tubes arranged in parallel between two chambers and in which a fluid medium circulates at a temperature greater than 120° C., wherein said cleaning bodies have contact surfaces for contacting inner walls of said tubes and removing deposits, and wherein said cleaning bodies are made of a material which maintains said contact surfaces at temperatures greater than 120° C.

10. Cleaning bodies according to claim 9, wherein said fluid medium is crude oil and wherein said material maintains said contact surfaces when in contact with crude oil.

11. Cleaning bodies of claim 9, wherein said cleaning bodies have said contact surfaces of a size selected to be forced against the tube inner wall.

12. Cleaning bodies according to claim 9, wherein said cleaning bodies comprise spherical resilient rolling bodies having a cleaning surface, and wherein an entire surface of said cleaning bodies forms said contact surface for removing deposits from the tube inner wall.

13. Cleaning bodies according to claim 9, wherein said cleaning bodies have an outer diameter in an uncompressed state which is greater than the inner diameter of said tubes and which adapts to said inner diameter when said cleaning bodies are introduced into inlet openings of said tubes and are resiliently compressed therein.

14. Cleaning bodies according claim 9, wherein said cleaning bodies comprise an inner buoyancy element and an outer cleaning element.

15. Cleaning bodies according to claim 14, wherein said buoyancy element comprises one or more pressure resistant hollow bodies.

16. Cleaning bodies according to claim 15, wherein said buoyancy element comprises a metal material.

17. Cleaning bodies according to claim 15, wherein said buoyancy element comprises bodies made of metal foam.

18. Cleaning bodies according to claim 15, wherein the cleaning bodies comprise a cleaning element which forms the contact surface and comprises at least one of a metal lamellae, knitted metal, metal mesh, metal foil, and a layer of abrasive material attached either directly to said buoyancy element or to an intermediate element.

19. Cleaning bodies according to claim 15, wherein a resilient elasticity medium carries said cleaning element.

20. Cleaning bodies according to claim 9, wherein said cleaning bodies comprise at least a downstream buoyancy element and an upstream cleaning element, downstream and upstream being with respect to a flow direction of liquid flow medium in said tubes.

21. Cleaning bodies according to claim 20, wherein each buoyancy element has a ball-shaped or spherical form and is made of metal sheeting or a high-temperature resistant plastics material.

22. Cleaning bodies according to claim 20, wherein each cleaning element is leaf or disk shaped, has a circular form and is made of spring metal, and carries a crown of resilient lamellae acting as contact surface and contacting the inner wall of the tube.

23. Cleaning bodies according to claim 20, wherein a connection between said buoyancy body and said cleaning element allows limited relative axial movement.

24. Cleaning bodies according to claim 23, wherein the connection further allows limited relative radial movement of said buoyancy body and said cleaning element.

25. Cleaning bodies according to claim 22, wherein said cleaning element has clover-leaf-shaped lamellae which are separated from one another by a gap.

26. Cleaning bodies according to claim 19, wherein a buoyancy element is arranged on each side of said cleaning element.

27. Cleaning bodies according to claim 14, wherein the material of said cleaning element, said resilient medium and said buoyancy element are resistant to temperatures greater than or equal to 120° C. as well as resistant to aggressive media, such as crude oil.

28. Cleaning bodies according to claim 27, wherein the material is metal.

29. Cleaning bodies according to claim 9, wherein said cleaning bodies are formed as roller shaped metal brushes.

* * * * *

UNITED STATES PATENT AND TRADEMARK OFFICE

CERTIFICATE OF CORRECTION

PATENT NO. : 7,055,580 B2
APPLICATION NO. : 10/719591
DATED : June 6, 2006
INVENTOR(S) : Hans-Werner Schildmann et al.

It is certified that error appears in the above-identified patent and that said Letters Patent is hereby corrected as shown below:

In column 16, claim 1, line 35, delete
"if or" and insert --for-- in its place.

In column 16, claim 6, line 54, delete
"Comprising" and insert --comprising-- in its place.

In column 17, claim 16, line 30, delete
"15" and insert --14-- in its place.

In column 18, claim 26, line 26, delete
"19" and insert --9-- in its place.

Signed and Sealed this

Twenty-fourth Day of April, 2007

JON W. DUDAS
*Director of the United States Patent and Trademark Office*